US011930874B1

(12) United States Patent
Aydelott

(10) Patent No.: US 11,930,874 B1
(45) Date of Patent: Mar. 19, 2024

(54) CAP STRAP WEIGHTED POUCH APPARATUS AND METHOD OF USE

(71) Applicant: Gary Horace Aydelott, Columbia, TN (US)

(72) Inventor: Gary Horace Aydelott, Columbia, TN (US)

( * ) Notice: Subject to any disclaimer, the term of this patent is extended or adjusted under 35 U.S.C. 154(b) by 0 days.

(21) Appl. No.: 18/235,114

(22) Filed: Aug. 17, 2023

Related U.S. Application Data

(60) Provisional application No. 63/399,654, filed on Aug. 20, 2022.

(51) Int. Cl.
*A42B 1/241* (2021.01)

(52) U.S. Cl.
CPC ..... *A42B 1/241* (2013.01)

(58) Field of Classification Search
CPC ..... A42B 1/24; A42B 1/241; A42B 1/248; A42B 1/116; A42B 1/0187; A42B 1/22; A42B 3/205; A41D 20/00; A41D 20/005; A63B 21/065; A63B 21/0602; A63B 21/0603; A63B 21/4003; A63B 23/025; A61F 7/10; A61F 2007/108
See application file for complete search history.

(56) References Cited

U.S. PATENT DOCUMENTS 2,181,446 A * 11/1939 Ames ..... A42B 1/0184 2/171.4
2,223,332 A * 11/1940 Sterne ..... A41D 20/00 2/209.3
2,648,112 A * 8/1953 Neumann ..... A44B 11/04 24/168
3,124,806 A * 3/1964 Campbell et al. ... A63B 71/146 473/59
3,820,780 A * 6/1974 Tarbox ..... A63B 21/065 273/DIG. 30
3,871,376 A * 3/1975 Kozak ..... A61L 15/52 607/114
4,142,721 A * 3/1979 Faleck ..... A63B 60/02 473/437
4,195,833 A * 4/1980 Svendsen ..... A63B 21/065 482/11
4,201,009 A * 5/1980 Burridge, Jr. ..... A63H 33/18 2/175.1
4,243,041 A * 1/1981 Paul ..... A61F 7/10 351/124
4,247,101 A * 1/1981 Gallmeyer ..... A63B 21/065 473/63
4,258,914 A * 3/1981 Lalli ..... A63B 21/065 434/254

(Continued)

*Primary Examiner* — Heather Mangine
(74) *Attorney, Agent, or Firm* — Master Key IP, LLP; Jeromye V. Sartain

(57) ABSTRACT

A pouch apparatus has a pouch body formed at its opposite ends with opposite widthwise slits and incorporates a weighted material, such that when selectively removably installed on a cap as by passing its one or more straps through the pouch slits and then securing such strap(s), the cap can be comfortably worn with the pouch apparatus so installed, providing benefits including discouraging the cap from being blown off, and further the cap with weighted pouch apparatus can be quickly removed and wielded as a self-defense weapon when needed.

17 Claims, 7 Drawing Sheets

(56) References Cited

U.S. PATENT DOCUMENTS 4,371,983 A * 2/1983 Piotti, Jr. ..... A63B 71/143 2/160
4,394,012 A * 7/1983 Egbert ..... A63B 21/065 2/250
4,632,389 A * 12/1986 Moss ..... A42B 1/24 273/DIG. 30
4,776,042 A * 10/1988 Hanson ..... A42B 1/008 2/909
4,789,270 A * 12/1988 Selisky ..... B63C 11/30 405/185
4,854,575 A * 8/1989 Wilson ..... A63B 21/0602 482/108
4,923,418 A * 5/1990 Hoffman ..... A63B 21/065 482/55
4,951,940 A * 8/1990 Vitello ..... B29C 43/003 224/148.1
4,995,604 A * 2/1991 Lynch ..... A63B 21/0606 434/254
5,003,640 A * 4/1991 Pizzacar ..... A42B 1/248 40/329
5,076,575 A * 12/1991 Eylander ..... A63B 21/065 482/139
5,088,549 A * 2/1992 Schneider ..... A61F 7/02 165/DIG. 45
5,146,630 A * 9/1992 Richard ..... A41D 20/005 2/171.2
5,162,032 A * 11/1992 Dohner ..... A43B 3/0031 482/105
5,169,371 A * 12/1992 Holmes ..... A63B 21/065 482/93
5,211,163 A * 5/1993 Mortenson ..... G01G 19/44 600/592
5,265,669 A * 11/1993 Schneider ..... A61F 7/02 62/530
5,287,559 A 2/1994 Christiansen et al.
5,305,470 A * 4/1994 McKay ..... A41D 20/005 2/171.2
5,418,981 A * 5/1995 Miner ..... A42B 1/248 2/209.13
5,428,844 A * 7/1995 Dougherty ..... A42B 1/248 2/209.13
5,447,482 A * 9/1995 Kusel ..... A63B 21/065 2/338
5,499,402 A * 3/1996 Rose ..... A42B 1/248 40/329
5,517,695 A * 5/1996 Murray ..... A42B 1/248 40/329
5,519,892 A * 5/1996 Pizzacar ..... A42B 1/248 40/329
5,533,213 A 7/1996 Reiner et al.
5,542,896 A * 8/1996 Qaiesi ..... A63B 21/065 482/105
5,546,605 A * 8/1996 Mallardi ..... A42B 1/22 2/209.13
D373,454 S 9/1996 Ramirez
D375,827 S * 11/1996 Will ..... D2/894
5,600,855 A 2/1997 Ramirez
5,632,047 A 5/1997 Van Den Heuvel
5,671,481 A * 9/1997 Giard ..... A41D 20/00 224/222
5,687,425 A 11/1997 Blosser
5,704,883 A * 1/1998 Eckmann ..... A63B 21/065 482/139
5,724,676 A * 3/1998 Amendolia ..... A42B 1/22 2/418
5,741,206 A * 4/1998 Anastasi ..... A63B 21/0722 482/141
5,848,981 A * 12/1998 Herbranson ..... A61F 7/10 606/201
5,857,220 A 1/1999 Erny et al.
5,918,316 A 7/1999 Nathanson et al.
D412,937 S 8/1999 Franklin
5,933,870 A * 8/1999 Egan, Jr. ..... A42B 1/24 2/181.6
5,938,089 A * 8/1999 Abreu-Marston ..... A63B 21/0602 224/267
5,938,572 A * 8/1999 Spano ..... A63B 21/065 482/105
6,006,362 A 12/1999 Walsh
6,024,762 A * 2/2000 Gray ..... A47G 9/1036 5/636
6,110,080 A * 8/2000 Niv ..... A63B 21/065 601/39
D431,709 S 10/2000 Cupps
6,131,249 A * 10/2000 Suenaga ..... A42B 1/22 24/442
6,200,243 B1 * 3/2001 Meranto ..... A63B 21/065 150/150
6,200,244 B1 * 3/2001 Cook ..... A63B 21/065 482/105
6,279,168 B1 8/2001 Bean
6,363,537 B1 * 4/2002 Park ..... A42B 1/22 2/181.2
6,694,575 B1 * 2/2004 Martin ..... A45F 5/02 206/315.3
6,857,134 B1 * 2/2005 Cowell ..... A42C 5/04 2/209.13
6,941,581 B1 * 9/2005 England ..... A42B 1/22 2/195.2
7,010,814 B2 * 3/2006 Benziger ..... A63B 23/025 2/171.2
7,077,303 B2 * 7/2006 Zega ..... B25H 3/006 224/904
7,101,314 B1 * 9/2006 Wang ..... A63B 21/065 482/93
7,211,031 B1 * 5/2007 Soloviev ..... A63B 21/4013 482/140
D605,381 S 12/2009 Mastrantonio et al.
9,955,744 B1 * 5/2018 Yanes ..... A42B 1/248
D865,334 S 11/2019 Kang
10,568,371 B1 * 2/2020 Murrer ..... A41D 20/00
10,952,486 B2 3/2021 Eldridge et al.
10,981,030 B2 * 4/2021 Henniger ..... A63B 21/0603
11,000,723 B2 * 5/2021 Borés Cifo ..... A43B 5/18
D931,579 S 9/2021 Eldridge et al.
11,357,278 B2 * 6/2022 Binns ..... A42B 1/22
2001/0027334 A1 * 10/2001 White ..... A47G 9/1036 607/108
2002/0108165 A1 8/2002 Porter et al.
2003/0073549 A1 * 4/2003 Hatch ..... A63B 21/065 482/92
2003/0193844 A1 * 10/2003 Elling ..... G04B 37/1433 368/282
2003/0208831 A1 * 11/2003 Lazar ..... A41D 13/0053 2/69
2005/0009670 A1 * 1/2005 Scafidel ..... A63B 21/0603 482/93
2005/0279786 A1 * 12/2005 Gac ..... A45F 5/02 224/181
2007/0044204 A1 * 3/2007 Kelly ..... A41D 20/00 2/171
2007/0099774 A1 * 5/2007 Bruback ..... A63B 21/0602 482/105
2008/0066214 A1 * 3/2008 O'Hare ..... A42B 1/241 2/243.1
2008/0109940 A1 5/2008 Van Den Heuvel et al.
2009/0151045 A1 * 6/2009 Hinds ..... A41D 20/00 2/170
2009/0205106 A1 * 8/2009 Sohn ..... A63B 71/14 607/114
2009/0275443 A1 * 11/2009 Friend ..... A63B 21/0603 482/13
2010/0024829 A1 * 2/2010 Dal Monte ..... A61H 1/0296 128/845
2010/0069206 A1 * 3/2010 Viselman ..... A63B 21/0602 482/106

(56) References Cited

U.S. PATENT DOCUMENTS

2011/0009713 A1* 1/2011 Feinberg ..... A61B 5/0205 482/8
2011/0053739 A1* 3/2011 Andrews ..... A63B 21/4001 482/141
2012/0046149 A1* 2/2012 Nilsen ..... A63B 21/4015 482/105
2012/0058863 A1* 3/2012 Brizard ..... A63B 21/0603 482/93
2014/0157472 A1* 6/2014 Crye ..... A42B 3/085 2/2.5
2014/0163607 A1* 6/2014 Tominaga ..... A61H 39/04 606/204.15
2014/0221161 A1* 8/2014 DePalma ..... A63B 21/4003 482/10
2015/0126294 A1* 5/2015 Williams ..... A42B 1/241 473/208
2015/0141213 A1* 5/2015 Calaman ..... A63B 21/065 482/105
2016/0059063 A1* 3/2016 Breibart ..... A63B 21/4007 482/123
2016/0128411 A1* 5/2016 Ayres ..... A42B 1/008 2/172
2017/0036056 A1* 2/2017 Tomellini ..... A63B 21/072
2017/0050072 A1* 2/2017 Connelly ..... B62J 9/22
2017/0276856 A1* 9/2017 Gagneux ..... F21L 4/02
2017/0318886 A1* 11/2017 Quiroz ..... A42B 1/02
2018/0104142 A1* 4/2018 Assaly ..... A63B 71/10
2018/0353792 A1* 12/2018 Henniger ..... A63B 21/0603
2019/0030394 A1* 1/2019 Orr ..... G16H 20/30
2019/0104853 A1* 4/2019 Fan ..... A42B 1/006
2019/0247699 A1* 8/2019 Gineris ..... A63B 21/4015
2019/0299046 A1* 10/2019 Tomellini ..... A63B 21/4035
2020/0054089 A1* 2/2020 Gong ..... A42B 1/006
2020/0215375 A1* 7/2020 Fujii ..... A63B 21/072
2020/0337893 A1* 10/2020 Bruder ..... A61F 7/02
2021/0016134 A1* 1/2021 Sbalbi ..... A63B 21/00065
2021/0331060 A1* 10/2021 Dhillon ..... A63B 21/4011
2021/0346777 A1* 11/2021 Coughlan ..... A63B 21/0603
2022/0015459 A1* 1/2022 Richman ..... A63B 71/141
2022/0248789 A1* 8/2022 Sturges ..... A42B 1/0182
2022/0256959 A1* 8/2022 Greenberger ..... A42B 1/008
2023/0009796 A1* 1/2023 Olander ..... A63B 21/4007
2023/0302320 A1* 9/2023 Phoeun ..... A63B 21/4035 482/93

* cited by examiner

CAP STRAP WEIGHTED POUCH APPARATUS AND METHOD OF USE

RELATED APPLICATIONS

This non-provisional patent application claims priority pursuant to 35 U.S.C. § 119(e) to and is entitled to the filing date of U.S. Provisional Patent Application Ser. No. 63/399,654 filed Aug. 20, 2022, and entitled "Cap Strap Weighted Pouch Apparatus and Method of Use." The contents of the aforementioned application are incorporated herein by reference.

BACKGROUND

The subject of this patent application relates generally to accessories for caps, and more particularly to a weighted pouch configured for removable installation on an adjustable cap strap.

The following description includes information that may be useful in understanding the present invention. It is not an admission that any of the information provided herein is prior art or relevant to the presently claimed invention, or that any publication specifically or implicitly referenced is prior art.

Applicant hereby incorporates herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, consumer demand for and use of "baseball caps," as they are commonly referred to, is massive globally and next to T-shirts and sweatshirts by volume produced and sold may be the single-greatest clothing item. Such caps are a part of most every casual wear or sportswear apparel company's product line, with such caps coming in an almost infinite variety of colors and styles and bearing the monikers of the world's leading global brands, sports teams, and all sorts of aesthetic or artistic designs and sayings, the front of the cap effectively becoming a wearable billboard of sorts.

While the variety of colors and styles of caps may be virtually infinite, the cap design itself is generally well-settled and universal as having a somewhat semi-spherical head covering portion, sometimes referred to as a dome or crown of the cap, and an integral bill extending laterally from the bottom edge of the head covering portion. The head covering portion may be formed from interconnected somewhat triangular panels of material, whether fabric or mesh or the like, and may be "fitted" or a fixed diameter or hat size. But the vast majority of caps produced and sold are adjustable in size as by having a semi-circular opening or cut-out formed in the head covering portion opposite the bill, with such opening then being sizable as by selectively interconnecting or fastening one or more straps. Such straps may be an opposed pair of overlapping straps, with respective straps extending toward one another from opposite lower edges of the opening or cut-out that are then removably engageable such as through forming the straps of fabric with Velcro® hook-and-loop fasteners or of plastic with snaps (spaced-apart pegs on one strap and respective spaced-apart holes in the other strap), or may be a single strap extending from one side of the opening or cut-out to the other and employing a snap, button, buckle, or other fastener that is adjustable along the free end of the strap and selectively attached on the cap opposite the fixed end of the strap.

With such adjustable baseball caps widely known and produced and worn for decades, over the years there have been proposed a variety of attachments or accessories for such straps, whether for aesthetics, such as displaying a logo or advertisement along the strap(s) and/or within the opening spanned by the strap(s), or for functionality, such as a member engaged with the strap(s) for comfort or sweat absorption. A few representative examples follow below.

U.S. Pat. No. 5,003,640 to Pizzacar discloses an advertising cap for a user having a back, a headband, a pair of straps disposed at the back of the conventional cap for adjustment of the size of the headband of the conventional cap, an advertising cap nameplate for concealing the pair of straps after the headband of the conventional cap is adjusted, and structure for removably mounting the advertising cap nameplate so that the advertising cap nameplate may be changed depending upon the preference of the user.

U.S. Pat. No. 5,287,559 to Christiansen discloses a fabric-covered foam rubber pad that is in a semicircular shape with a small slot gap in the center of the foam rubber pad that provides a hinge to allow it to easily fold in half and provide room for the sizing strap of a baseball-style cap. Hook-and-loop fasteners are attached to one side of the structure so that when placed up, under, and over a baseball-style cap's sizing strap it can be folded in half and secured in place.

U.S. Pat. No. 5,418,981 to Miner discloses an emblem bearing cap attachment having a substantially planar, relatively stiff body defining a forward surface and a rearward surface. A primary crease extends centrally across the planar body defining an upper facing panel and a lower backing panel. The primary crease facilitates folding of the body about and capturing the adjustable straps of a baseball style cap to position the rearward surface of the facing panel in confronting relationship with the rearward surface of the backing panel whereat are fastening means to secure the panels together. The facing panel completely closes the semicircular opening at the rear of the cap and allows the display of emblems or other indicia thereon.

U.S. Pat. No. 5,428,844 to Dougherty discloses a cushioning, sweat-absorbing, advertising sweatband which is easily attached and removed from an existing hat or headgear that has an exposed headband. The band is a piece of material that has a foam cushion inserted inside the material and sewn in such a way as to form three distinct rectangles which are wrapped around each other and mate together through hook and loop fasteners over the exposed headband of a hat, such as an adjustable baseball cap.

U.S. Pat. No. 5,499,402 to Rose discloses caps of the type used by baseball players but also used by other athletes and their fans that have an opening at the back. A strap is attached to the headband of the cap on either side of the opening and the straps can be used to adjust the cap to fit the head size of the wearer by overlapping the ends of the straps to the necessary extent. One strap usually has spaced holes and the other spaced studs which fit into the holes. The present invention provides a panel which may carry the logo of a team, a merchandiser's advertisement, or other design. The panel is secured to the overlapped straps in various ways described in detail.

U.S. Pat. No. 5,519,892 to Pizzacar discloses an improved advertising nameplate for a cap to be worn on a head of a person. The cap has a crown with a headband and a pair of adjustment straps at the back of the crown to adjust the size of the headband. The nameplate consists of a structure for concealing the pair of adjustment straps after the headband on the crown is adjusted. Such apparatus is for removably mounting the concealing structure to the pair of adjustment straps, so that the concealing structure may be changed depending upon the preference of the person. A logo for advertising is disposed directly onto the concealing structure, so that the logo may be displayed therefrom.

U.S. Pat. No. 5,533,213 to Reiner et al. discloses a display attachment formed of a single planar piece of material, such as polyethylene, that includes at least one aperture adjacent to its lowermost edge. The at least one aperture is sized such that at least one pin or projection of one portion of a sizing strap can extend through at least one aperture of the display attachment with the at least one projection extending through at least one of the openings on the other portion of a baseball style cap sizing strap so as to secure or engage the display attachment between the two portions of a baseball style cap sizing strap.

U.S. Pat. No. 5,600,855 to Ramirez discloses a decorative cover for the adjusting straps on a cap of the type having overlapping adjusting straps in the back, wherein the cover is made from a flat sheet of material folded to define looped ends and generally parallel front and back panels. The panels are adapted to be disposed on opposite sides of the adjusting straps with the looped ends disposed in proximity to one another. Removable fasteners are received in the looped ends to retain the folded sheet of material in place on the adjusting straps. Advertising or other promotional material or decorative items may be placed on the front panel. In one form of the invention, the fasteners are bobby-pin-shaped spring clips which are inserted into opposite ends of the looped ends. In another form of the invention, the fasteners are magnets which are received in the looped ends so that the looped ends are held together when they are placed in proximity with one another.

U.S. Pat. No. 5,632,047 to Van Den Heuvel discloses an attachment useful for a conventional type sports cap which has a fabric dome, a headband surrounding the dome, a pair of straps at the rear of the cap for adjustment of the size of the headband and an opening in the dome of the cap above the straps. The attachment has a planar member having a first surface, a second surface, a top area and an opposite bottom area. An indicia means is provided on the first surface for displaying a trademark and/or logo. At least one fastening means is provided on the top area of the second surface for removably fastening the attachment means to the fabric of the cap. There is at least one fastening member on the bottom area of the second surface for removably fastening the attachment to the strap of the cap. Preferably the fastening member is a hook member which hooks onto the straps. The planar member is of a size, and the fastening means and the fastening member are arranged on the second surface in such a manner, that when the fastening member is fastened to the straps and the fastening means is fastened to the fabric surrounding the opening, the attachment substantially covers the opening and the indicia means displays the trademark and/or logo.

U.S. Pat. No. 5,687,425 to Blosser discloses a cap strap cushion that is attachable to one or more adjustable straps of a baseball-style cap. The cushion includes a tubular member having a first open end and a second open end, each of the open ends defining an inseparable edge. An interior channel extends the length of the tubular member, from the first open end to the second open end. The first and second open ends each are configured so that the adjustable straps can be inserted into and through the interior channel. The tubular member is sized such that when the adjustable straps are inserted into and through the channel, the tubular member fits thereon. The tubular member may be stitched from the edge of the first open end to the edge of the second open end. A soft, pliable material, such as fleece, may be employed in the subject invention. The cap strap cushion may accommodate a plurality of engaged adjustable straps having differing lengths. A method of using the cap strap cushion of the present invention is also disclosed.

U.S. Patent Application Publication No. US20020108165A1 to Porter discloses headgear having a body and a strap which is removable from the body so as to be replaceable and interchangeable. Each of the straps may have a logo or other indicia displayed thereon. By interchanging straps with varying indicia, the user can change the decorative appearance of the headgear. In addition to its decorative function, the strap may be elastic and when attached to the body proximate opposed ends of a headband of the headgear such that the elastic nature of the strap will allow the headgear to expand or contract to conform to the head size of a wearer. The strap has opposed ends and is removably connected to the body by attachment means which may comprise hook assemblies permanently connected to the opposed ends of the strap, the hook assemblies each engaging respective grommets set into the body.

U.S. Pat. No. 10,952,486 to Eldridge et al. discloses an attachment for mounting on straps extending between a rear opening of a cap. The attachment comprises a first panel having an outer and inner surface, and a clip section comprising a connector and a second panel having an outer and inner surface. The panels are spaced such that the first and second panels face each other and are substantially parallel to each other. The connector connects the first panel and the second panel at the top edge of the first panel and defines a gap between the panels. The gap is sufficient to permit the strap or straps to nest within, such that when the strap or straps are nested, the first and second panels lie on opposite sides of the strap or straps. The first and second panels contain ridges along their edges that engage the strap or straps and keep the cap attachment in place. The outer surfaces of the panels display advertising indicia or decoration and have a cushioned area.

What has been needed and heretofore unavailable is a removable cap strap accessory having improved engagement with the cap strap(s) and new and novel functionality beyond the display and cushioning aspects known in the art, with no such known cap strap attachments, though seemingly disclosing every conceivable means of attaching the cover to the cap strap, disclosing such an accessory as having opposite slits for the strap(s) to pass through, instead such prior art covers looping or sliding over, wrapping around, or clipping onto the strap(s), let alone disclosing that the cap strap accessory would be in the form of a weighted pouch that serves as a personal protection device and provides other benefits when worn. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a cap strap weighted pouch apparatus. In at least one embodiment, the pouch apparatus has a pouch body that is formed at its opposite ends with opposite widthwise slits and incorporates a weighted material, such that when selectively removably installed on a cap as by passing its one or more straps through the pouch slits and then securing such strap(s), the cap can be comfortably worn with the pouch apparatus so installed, providing benefits including discouraging the cap from being blown off, and further the cap with weighted pouch apparatus can be quickly removed and wielded as a self-defense weapon when needed.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
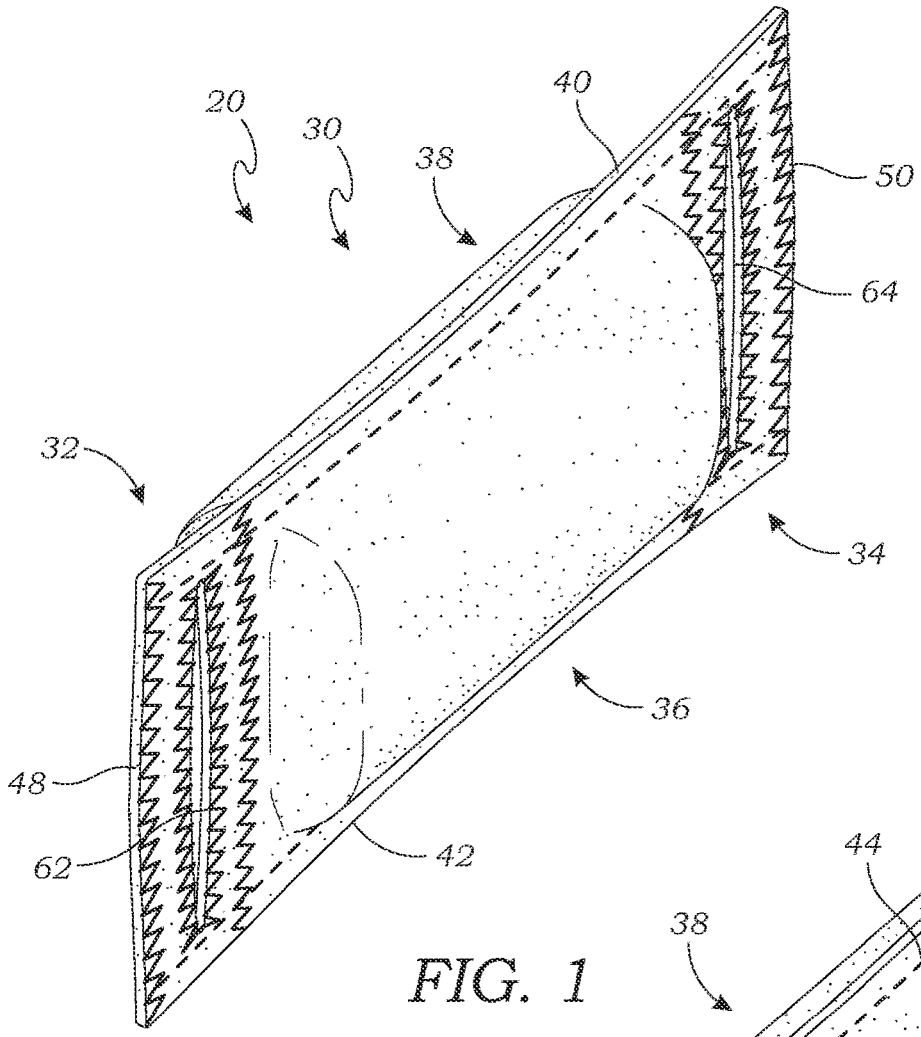
FIG. 1 is a perspective view of an exemplary cap strap weighted pouch apparatus, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of any appended claims.

Figure 2:
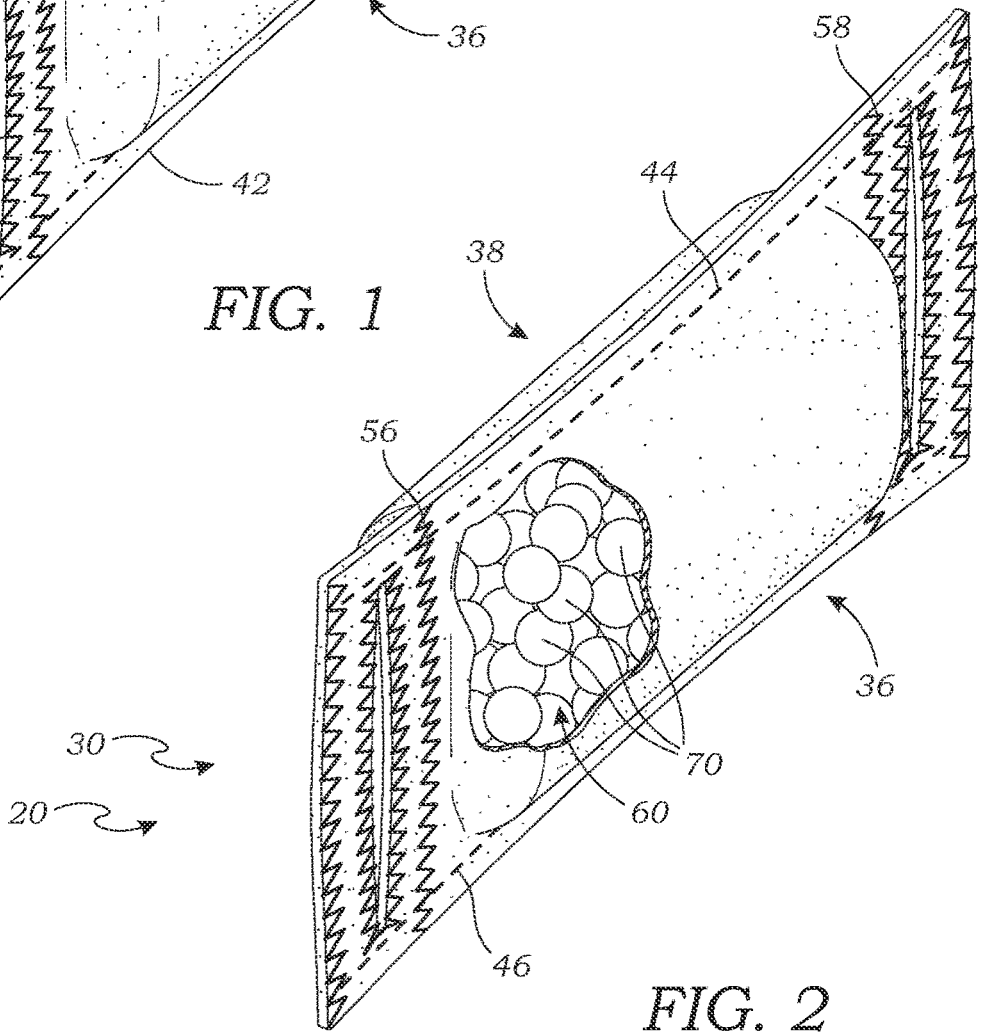
FIG. 2 is a partially cutaway perspective view thereof, in accordance with at least one embodiment.

Turning now to FIGS. 1 and 2, there are shown perspective views of an exemplary embodiment of a cap strap weighted pouch apparatus 20 according to aspects of the present invention. The apparatus 20 comprises, in the exemplary embodiment, an elongate hollow somewhat tubular pouch body 30 that is formed at its opposite first and second ends 32, 34 with opposite first and second widthwise pouch slits 62, 64 and is filled with a weighted material 70. At a high level, the pouch slits 62, 64 are configured (sized and oriented) to accommodate selective insertion therethrough of an adjustable strap S1, S2 of a baseball cap C so as to position the pouch apparatus 20 along the cap strap(s) S1, S2, and the weighted material 70 held within the pouch body 30 then provides a number of benefits in use with the pouch apparatus 20 so positioned on the cap strap(s) S1, S2, more about which is said below in connection with FIGS. 6-11. It will be appreciated that a cap strap weighted pouch apparatus 20 according to aspects of the present invention may take a number of configurations beyond that shown and described without departing from the spirit and scope of the invention, such that the exemplary embodiment is to be understood as illustrative and non-limiting, as will be further appreciated by the detailed description that follows.

The pouch body 30 again has a somewhat tubular construction in the exemplary embodiment, whether formed as a continuous tubular wall, from a single piece of rectangular material folded or effectively rolled lengthwise and joined along its opposite long edges, or from two pieces of rectangular material joined along respective opposite long edges, in any case then having the volume bounded by or within the tubular pouch body closed as by stitching, sealing, welding, gluing or adhering, or otherwise affixing opposite widthwise ends of the pouch body 30, whether or not at the widthwise edges, to define a bounded pouch interior space 60. It will be appreciated that in the case of the first and second sides 36, 38 being separate, such may be formed of the same material or two different materials, depending on a number of considerations as explained further below. Before being closed at least at one end, the tubular pouch body 30 or specifically its interior volume or space 60 may be substantially filled with a weighted material 70 that, once the pouch body 30 is closed on all sides, cannot escape or is retained within the pouch interior space 60. Notably, then, any such stitching, sealing, welding, or the like as defining the lateral or widthwise limits of the pouch interior space 60 cannot be intersected by any slits, holes, or other features formed in the pouch body 30, which features must instead be outward of the pouch interior space 60 and any structure that defines or fixes its boundaries.

Figure 3:
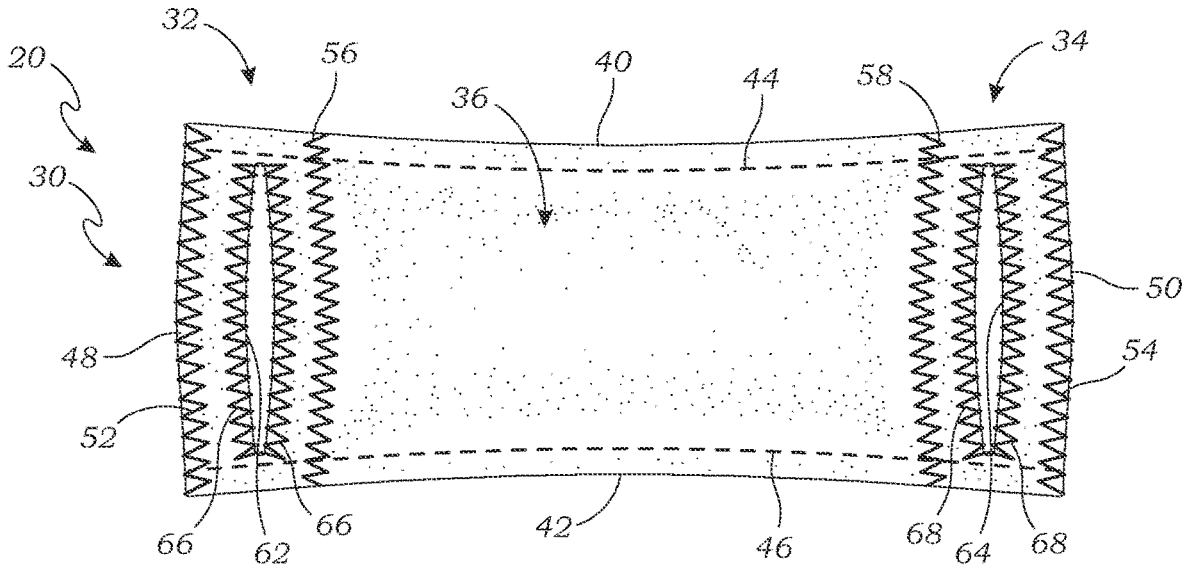
FIG. 3 is a front view thereof, in accordance with at least one embodiment.
Figure 4:
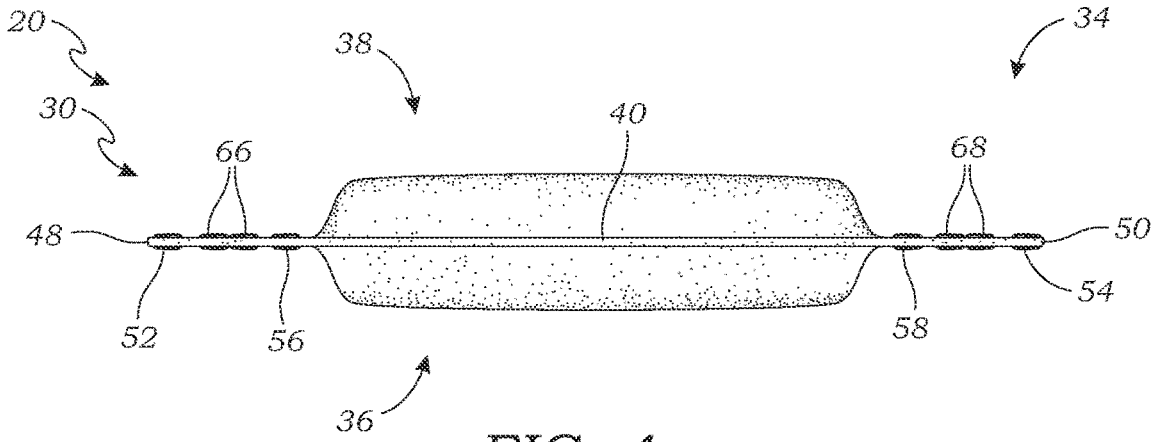
FIG. 4 is a top view thereof, in accordance with at least one embodiment.
Figure 5:
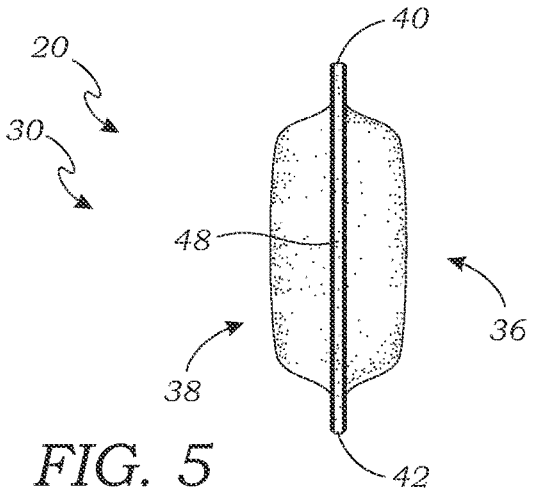
FIG. 5 is a left side view thereof, in accordance with at least one embodiment.
Figure 6:
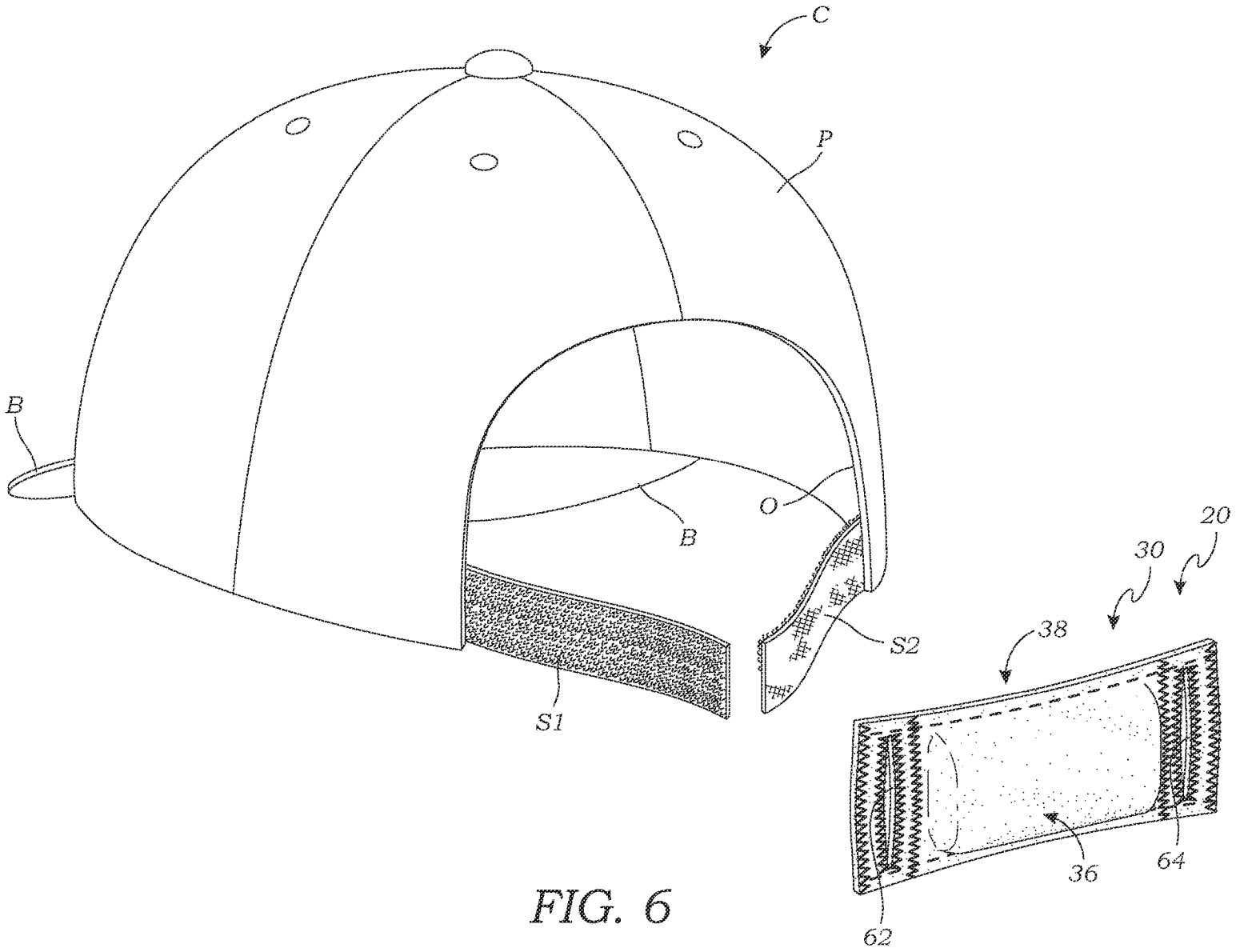
FIG. 6 is a reduced-scale perspective view thereof in a first operational mode relative to a baseball cap, in accordance with at least one embodiment.

With continued reference to FIGS. 1 and 2 and now also referring to FIGS. 3-5, the pouch body 30 of the exemplary cap strap weighted pouch apparatus 20 according to aspects of the present invention generally has opposite first and second ends 32, 34 and opposite first and second sides 36, 38 having respective opposite first and second lengthwise edges 40, 42 and respective opposite first and second widthwise edges 48, 50 together defining the somewhat rectangular shape or profile of the overall pouch body 30 and thus the pouch apparatus 20. As shown in the exemplary embodiment involving a fabric pouch body 30 or the like, stitching is employed in forming the various edges or features and thus in effectively joining the first and second sides 36, 38; namely, first and second lengthwise edge stitches 44, 46 join or form or otherwise run along the respective first and second lengthwise edges 40, 42 and first and second widthwise edge stitches 52, 54 join or form or otherwise run along the respective first and second widthwise edges 48, 50 to form the perimeter of the pouch body 30. First and second widthwise intermediate stitches 56, 58 also join the opposite first and second sides 36, 38 here inset lengthwise from the first and second widthwise edge stitches 52, 54. It will be appreciated by those skilled in the art that on this basis the first and second lengthwise edge stitches 44, 46 and the first and second widthwise intermediate stitches 56, 58 intersect each other in four respective corners and together fully bound and set apart the interior space 60 of the pouch body 30 in which the weighted material 70 is contained. It will also be appreciated that there are thereby formed regions within the pouch body 30 set apart from the interior space 60, namely, the areas of the first and second sides 36, 38 between the first widthwise edge and intermediate stitches 52, 56 and between the second widthwise edge and intermediate stitches 54, 58, within which areas at the first and second ends 32, 34 of the pouch body 30 are safely and operably formed the respective first and second pouch slits 62, 64. As shown, the pouch slits 62, 64 are formed at respective opposite first and second ends 32, 34 of the pouch body 30 as transverse openings completely through or communicating between the opposite first and second sides 36, 38, here with respective reinforcing first and second pouch slit stitches 66, 68 thereabout. In the exemplary embodiment, the first and second pouch slits 62, 64 do not intersect the first and second lengthwise edge stitches 44, 46 let alone the first and second lengthwise edges 40, 42 themselves but are thus contained within the first and second sides 36, 38 of the pouch body 30, though in alternate versions such slits 62, 64 may take other forms so long as accommodating and securing the typical adjustable cap straps S1, S2 (FIGS. 6-9). Once again, those skilled in the art will appreciate that all such configurations and assembly means for the various components of a cap strap weighted pouch apparatus 20 according to aspects of the present invention are merely illustrative of features and aspects thereof and non-limiting.

Figure 10:
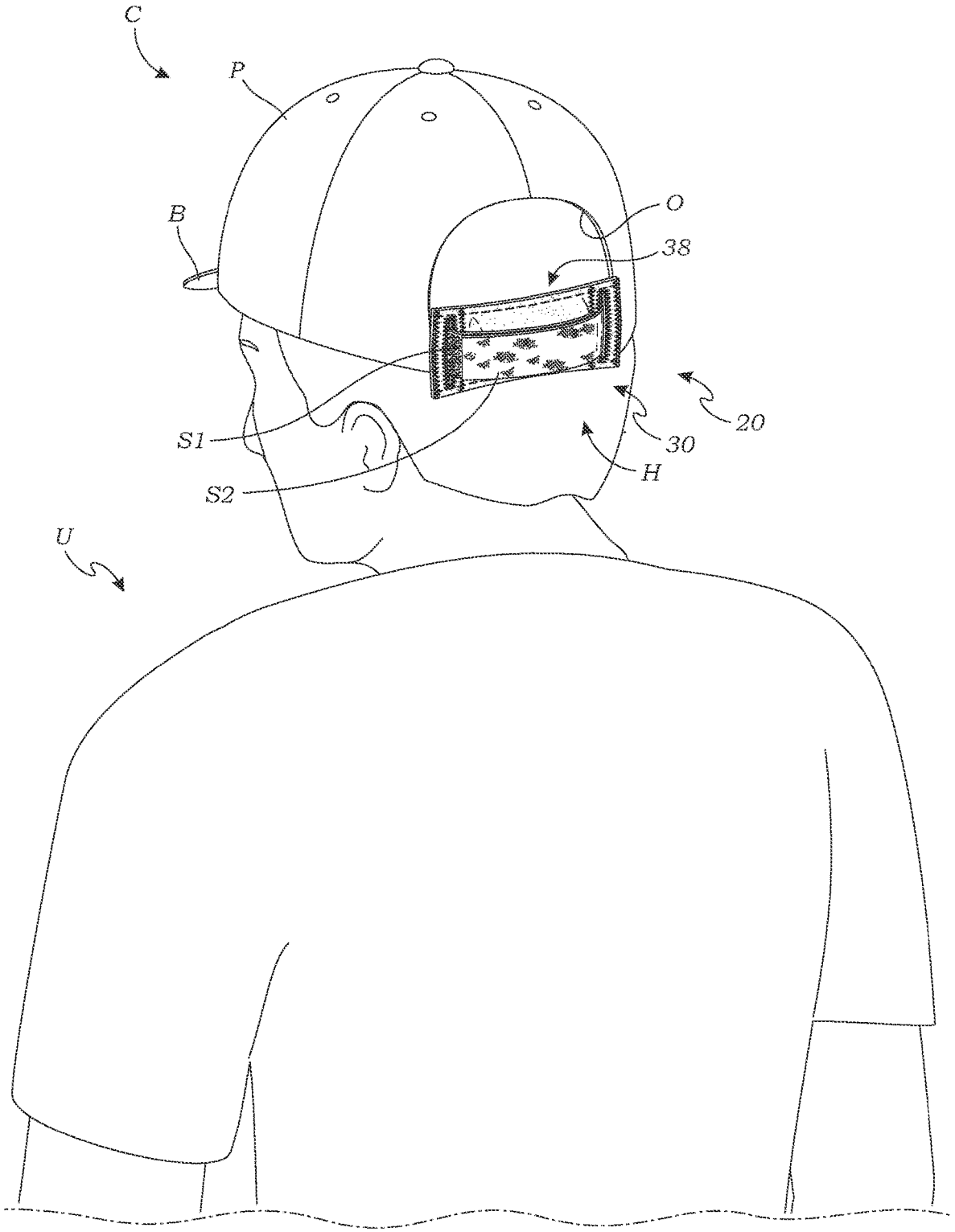
FIG. 10 is a further reduced-scale perspective view thereof in the third operational mode relative to the baseball cap as shown in FIG. 8 now in use as being worn, in accordance with at least one embodiment.
Figure 11:
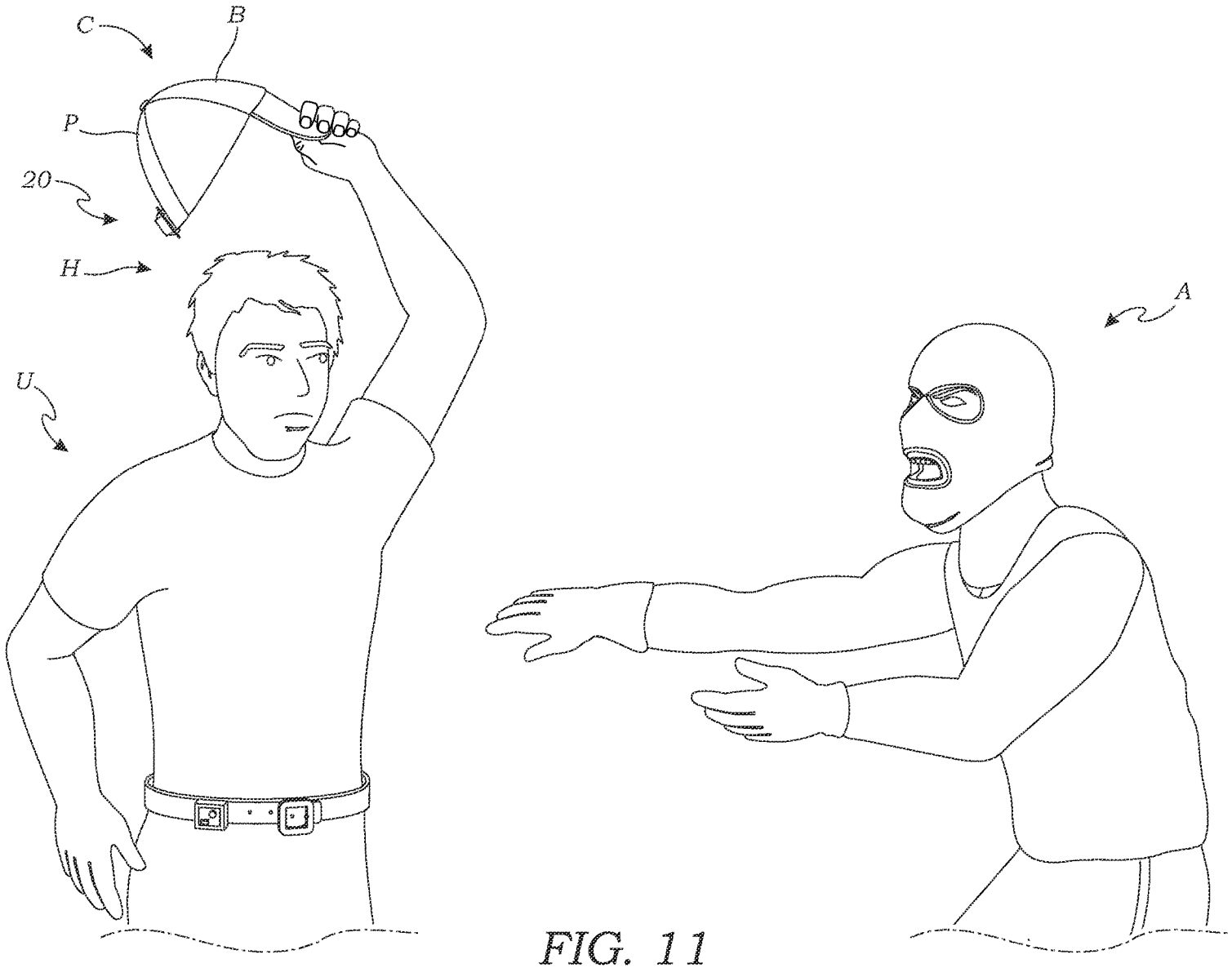
FIG. 11 is a further reduced-scale perspective view thereof in the third operational mode relative to the baseball cap as shown in FIG. 8 now in use as a personal protection device, in accordance with at least one embodiment.

With reference particularly to FIG. 2 showing a partially cutaway perspective view of the exemplary cap strap weighted pouch apparatus 20, the weighted material 70 contained within the pouch interior space 60 bounded by the pouch body 30 may entail any appropriate material having sufficient properties, particularly density (or mass per unit volume), such that on earth the effective weight of the pouch apparatus 20 is as desired and as also fitting within the desired volume or size of the pouch 20, such as roughly one to five ounces (1-5 oz.) or roughly one sixteenth to five sixteenths pound (1/16-5/16 lb.), though it will be appreciated that greater or less weight may be employed depending on a number of factors, including but not limited to the overall size of the pouch 20. Preferably, in the exemplary embodiment of a somewhat tubular rectangular-shaped pouch 20 that is overall generally about one-and-a-half inches by three-and-a-half inches (1.5 in.×3.5 in.), the weight of the pouch 20 or more specifically that of the weighted material 70 is approximately three ounces (3 oz.) or roughly three-sixteenths pound (3/16 lb.), such as comprising approximately three hundred (300) 5.1-grain nominally 0.177-inch caliber or diameter steel or other metal balls commonly referred to as "ball bearings" or "BBs" for short (hereinafter "BB" (singular) or "BBs" (plural)), though it will be appreciated that a variety of such weighted materials and the amount thereof can be employed in a cap strap weighted pouch apparatus 20 according to aspects of the present invention. By way of further illustration and not limitation, while BBs are shown and described as the exemplary weighted material 70, other materials that may be employed include granular materials such as sand, beads, beans, etc., semi-solid materials such as gel, or even liquids such as water. Moreover, such weighted material 70 may be incorporated on or in or otherwise be formed or integrated with the pouch body 30 and so is not necessarily contained within the pouch interior space 60; indeed, the material of the pouch body 30 itself may be selected as having sufficient density or weight to meet the objectives of aspects of the present invention, such as for example yielding an overall weight of approximately one to five ounces (1-5 oz.) or roughly one sixteenth to five sixteenths pound (1/16-5/16 lb.) in the exemplary embodiment. Any such materials now known or later developed having an appropriate density and thus weighting of the apparatus 20 may be employed, with the material and construction of the pouch body 30 being adapted as appropriate, such as in the case of a weighted material 70 contained within the pouch interior space 60 so as to effectively contain the weighted material 70 of whatever kind therein, again comprising any material or method of manufacture or assembly now known or later developed, more about which is said below, for example including a rubber material or interior layer in or on the first and second sides 36, 38 of the pouch 30 to prevent transmission or seepage from within the pouch interior space 60 of a more fluid or relatively small particulate-type weighted material 70. Related implications of a variety of such weighted materials 70 are discussed further below in connection with use of the pouch apparatus 20 as illustrated in FIGS. 10 and 11.

Referring still to FIGS. 1-5, dimensionally, for the exemplary pouch apparatus 20 fully assembled (i.e., filled with weighted material 70 versus being flat), the pouch body 30 is nominally three and three-quarter inches long by one-and-a-half inches wide by three-quarter inch high (3-¾ in.×1-½ in.×¾ in.). Those skilled in the art will appreciate that particularly the length of the pouch body 30 is limited by and should not be any longer than the typical cap opening or cut-out O is wide (FIGS. 6-9), while the width and height or thickness of the pouch body 30 can vary or increase in size moreso. Continuing with the exemplary embodiment, the length of each slit 62, 64 is nominally one inch (1 in.) so as to accommodate the widths of typical adjustable straps S1, S2 employed in baseball caps C (FIGS. 6-9). Once again, while the resulting pouch body 30 is shown and described as having a somewhat rectangular profile, it will be appreciated that such is not required and the configuration or size and shape of the overall pouch body 30 can vary widely. Moreover, even as to the nominally rectangular configuration of the pouch body 30, it is noted that due to the bulge across the intermediate area where the pouch interior space 60 is filled with the weighted material 70, this may cause the long edges 40, 42 of the pouch body 30 to then be a bit inwardly curved, which it will be appreciated can be mitigated by starting with one or more pieces of somewhat rectangular material that are actually slightly outwardly-curved along their long edges when flat, if desired. These and other variations are again possible according to aspects of the present invention, such that the exemplary pouch apparatus 20 including its size and shape is to be understood as illustrative and non-limiting.

The material of the pouch body 30 may be any suitable material now known or later developed, including but not limited to seventeen to twenty-one ounce (17-21 oz.) heavy-weight denim. Similarly, any such pouch body material may be affixed to itself in forming the various edges or seals using any appropriate material and method now known or later developed, including stitching, sealing, welding, or gluing or adhering, in the case of stitching including but not limited to one hundred percent (100%) bonded nylon upholstery thread. Once again, any appropriate textile or fabric, rubber, or other material now known or later developed, including but not limited to various synthetic materials, may be employed, and for fabrics or textiles whether as a blend, woven, or laminate construction of one or more of cotton, polyester, nylon, elastane, and other such fibers or materials. And all such components may again be joined, installed, or affixed one to another using any appropriate stitch, whether single or double or more, and of whatever type or density in terms of stitches per inch, weld, bond, or other appropriate joining means now known or later developed in forming the completed pouch apparatus 20 including its interior space 60 for operably containing the weighted material 70, in large part depending on the selected pouch material for a particular application or commercial context. Furthermore, regardless of the configuration of the pouch body 30, its material, or a portion thereof such as a skin or outer layer or laminate, may define the first and/or second sides 36, 38 or be formed or applied on or over the first and/or second sides 36, 38 to provide additional desired properties, such as moisture impermeability or resistance on the one hand or moisture permeability for wicking or sweat absorption properties on the other hand. Accordingly, once again, the first and second sides 36, 38 may be formed of the same material or two different materials, such as to have a wicking or sweat absorbing or moisture permeable layer or material on a side that is to be worn against the skin but not necessarily the opposite side. Similarly, the weighted material 70 may also have additional moisture resistance or absorption properties, thermal or heat exchange properties, and the like. By way of further example, an anti-fungal or anti-bacterial agent may be incorporated or impregnated in or applied to the material of the pouch body 30 itself and/or any skin or covering or coating applied thereon and/or in or on the weighted material 70. Again, it will be appreciated by those skilled in the art that a variety of configurations of the pouch body 30 and the weighted material 70 beyond that shown and described are possible according to aspects of the present invention, such that the exemplary embodiment is to be understood as illustrative and non-limiting.

Figure 7:
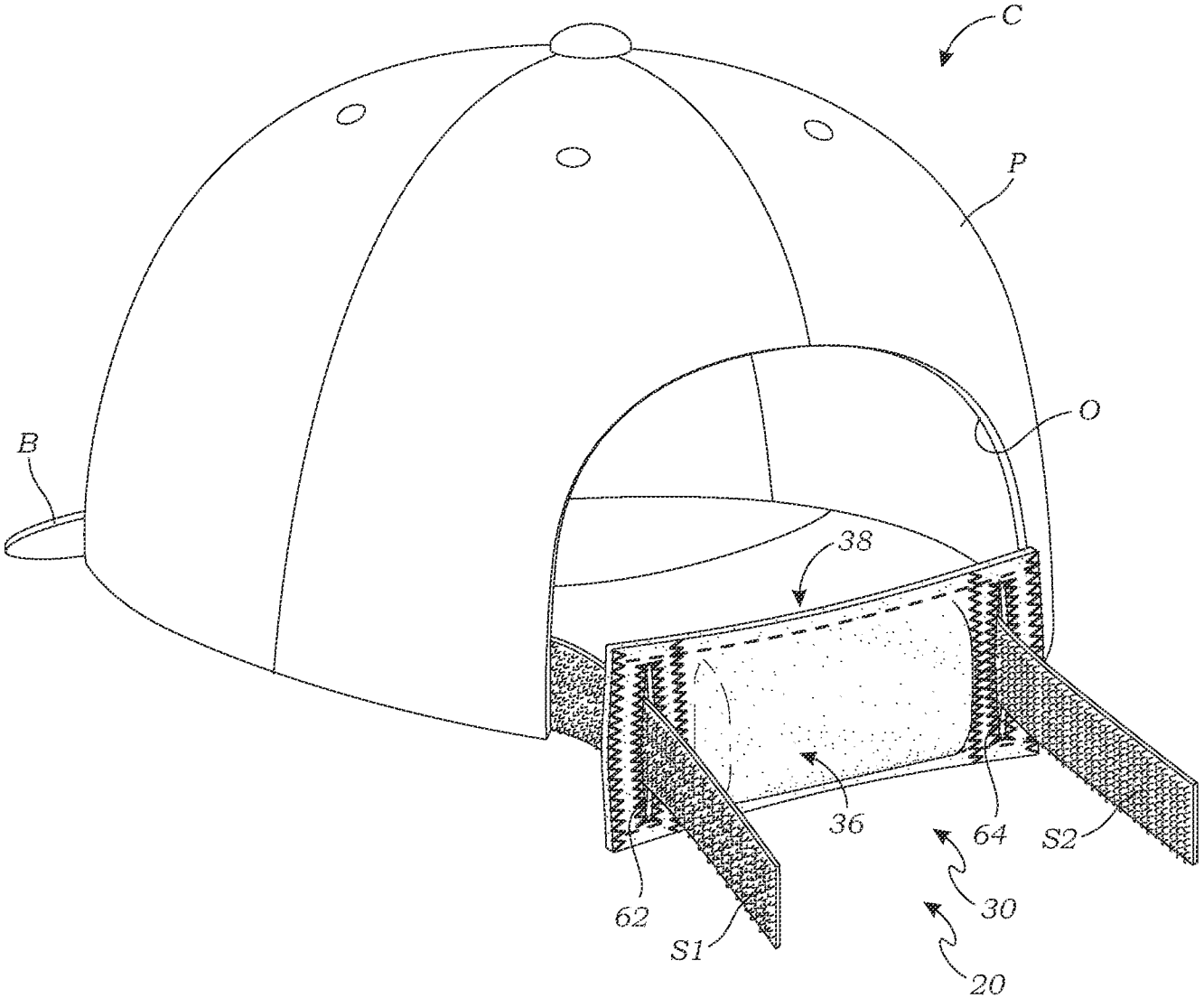
FIG. 7 is a further perspective view thereof in a second operational mode relative to the baseball cap, in accordance with at least one embodiment.
Figure 8:
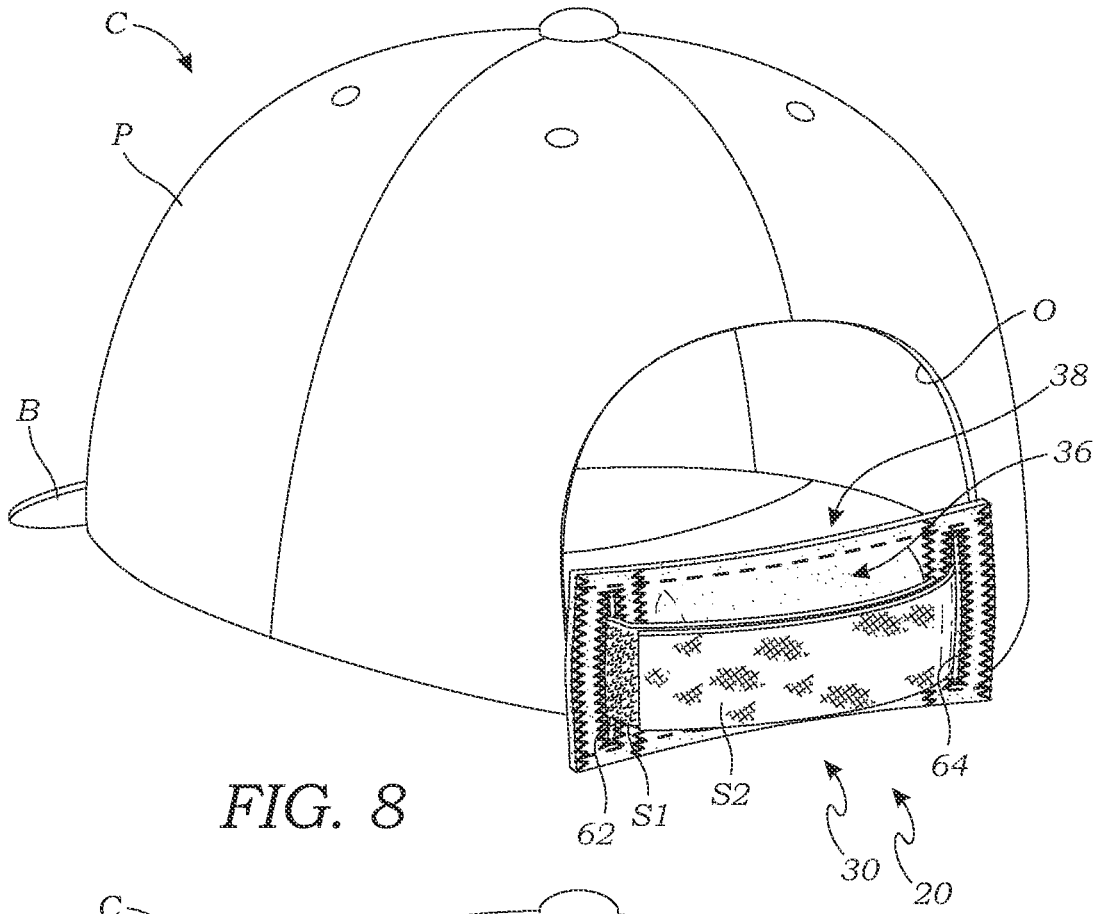
FIG. 8 is a still further perspective view thereof in a third operational mode relative to the baseball cap, in accordance with at least one embodiment.
Figure 9:
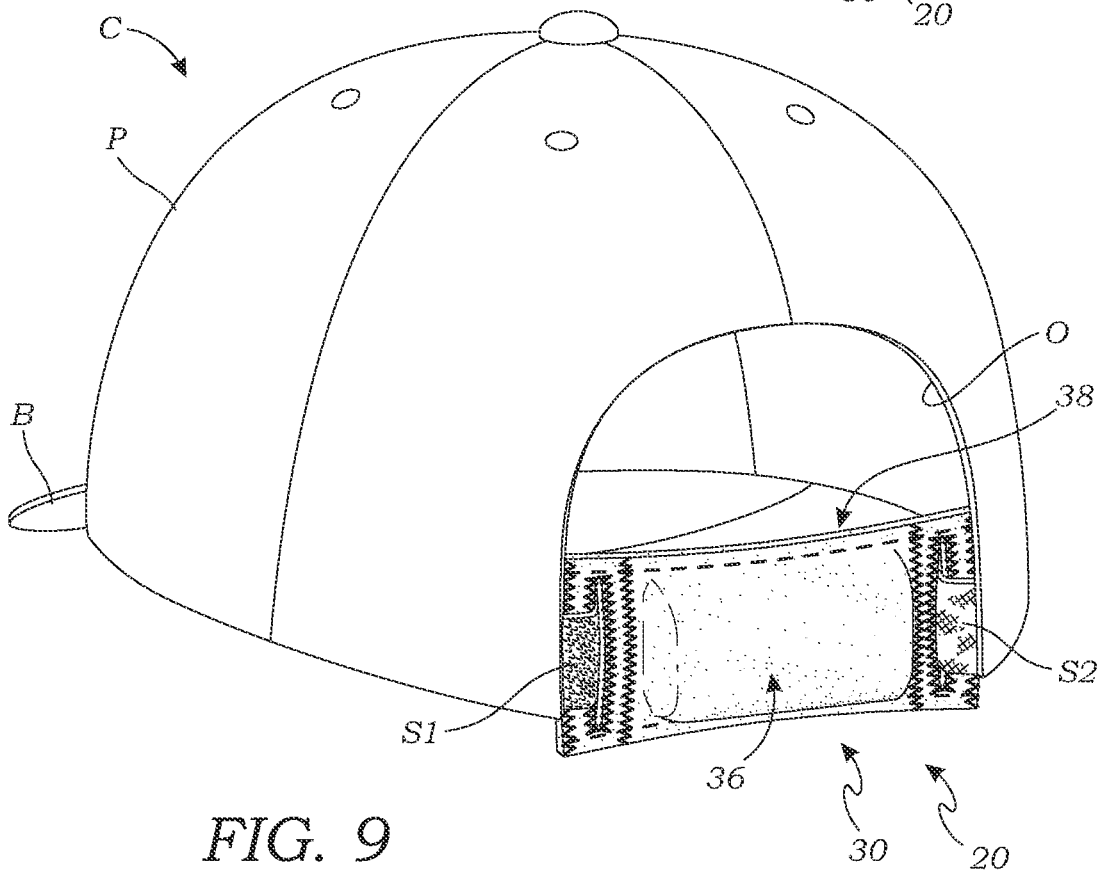
FIG. 9 is a still further perspective view thereof in an alternative third operational mode relative to the baseball cap, in accordance with at least one embodiment.

Referring now to FIGS. 6-9, a baseball cap C may be selected for use of a generally common construction or configuration having a dome or crown or head covering portion P with a bill B affixed so as to extend generally outwardly from a bottom band or edge of the head covering portion P and having a somewhat semi-circular cut-out or opening O in the head covering portion P opposite the bill B with opposed selectively-engageable straps S1, S2 extending toward one another across the opening O somewhat at the bottom or base thereof, as effectively a size-adjustable continuation of the headband of the head covering portion P as is known and widely practiced in the art. Once again, those skilled in the art will appreciate that while two opposed straps S1, S2 are shown and described, here as having mating hook-and-loop fastener swatches formed or affixed thereon for selective removable engagement of the straps S1, S2, any such adjustable cap C now known or later developed as having at least one strap selectively spanning the cut-out or opening O or the like of such a cap C may be employed in conjunction with a cap strap weighted pouch apparatus 20 according to aspects of the present invention, including but not limited to opposite plastic straps with snaps (spaced-apart pegs on one strap and respective spaced-apart holes in the other strap) or a single strap extending from one side of the cut-out or opening O to the other and employing a snap, button, buckle, or other fastener that is adjustable along the free end of the strap and selectively attached on the cap C opposite the fixed end of the strap. Continuing with the exemplary cap C of FIG. 6, to prepare the cap C for removable receipt of the pouch apparatus 20, the opposite straps S1, S2 are first disconnected from each other as shown, with the pouch apparatus 20 brought into proximity. Next, as shown in FIG. 7, each of the straps S1, S2 would be selectively passed through the respective pouch slits 62, 64 until, as shown in FIG. 8, the pouch body 30 is sufficiently advanced along the straps S1, S2 such that the straps S1, S2 are then simply re-engaged, again, here as by pushing the straps S1, S2 against each other so that the hook-and-loop fasteners attach thereby setting the desired size of the cap C or effective circumference of the head covering portion P now including the pouch apparatus 20 and specifically the pouch body 30 lying along the straps S1, S2. Specifically, it will be appreciated that in the illustrated usage of FIGS. 7 and 8, the cap straps S1, S2 are passed through the pouch slits 62, 64 from back to front or from the second side 38 of the pouch body 30 toward the opposite first side 36, with the straps S1, S2 then lying along the outer first side 36 of the pouch body 30 when engaged and the inner second side 38 of the pouch body 30 being positioned adjacent to the head H of the user U when the cap C is then worn as shown in FIG. 10. Alternatively, it will be appreciated that the straps S1, S2 may instead be passed through the pouch slits 62, 64 from front to back or from the first side 36 of the pouch body 30 toward the opposite second side 38, with the straps S1, S2 then lying along the inner second side 38 of the pouch body 30 when engaged as shown in FIG. 9 and thus being adjacent to the head H of the user U when the cap C is then worn, here with the outer first side 36 of the pouch body 30 then being exposed or entirely visible or uncovered when the cap C is worn. Those skilled in the art will thus appreciate that the pouch body 30 may in some uses be more visible than in others and regardless may include a variety of colors, designs, patterns, artwork, text, etc. to further embellish the pouch apparatus 20 and the cap C itself when worn. Indeed, it will be appreciated also that the sides 36, 38 of the pouch body 30 being "first" or "second" or being oriented inwardly or outwardly or toward or away from the wearer's head H is arbitrary, such that either side 36, 38 of the pouch body 30 may be oriented inwardly or outwardly when worn and thus the two sides 36, 38 of the pouch body 30 may even have two different aesthetic configurations that due to the symmetry and thus reversability of the pouch apparatus 20 can be alternately displayed by the user U simply by selecting which side 36, 38 is to be oriented inwardly and which side 36, 38 is to be oriented outwardly when the pouch apparatus 20 is removably installed on the cap C, adding to the variability and customizability of a pouch apparatus 20 according to aspects of the present invention along of course with the user selectability of having the cap straps S1, S2 along either the outer side 36 or inner side 38 of the pouch body 30 as illustrated in FIGS. 8 and 9, respectively.

Turning next to FIG. 10, with a cap strap weighted pouch apparatus 20 according to aspects of the present invention removably installed on an exemplary adjustable cap C in the manner shown in FIG. 8, the cap C may simply be worn in the ordinary fashion as by positioning the head covering portion P over the head H of the user U with the bill B generally forward and the opening O and thus the straps S1, S2 and the pouch apparatus 20 rearward at the back of the head H, though it will be appreciated that the cap C even with the pouch apparatus 20 removably installed thereon can still be worn in other orientations as well, such as backwards. When worn as shown, the pouch apparatus 20 is thus comfortably and discretely positioned at the back or base of the head H, and with its relatively minimal weight of up to on the order of five ounces (5 oz.), the weighted pouch is in a sense hardly felt by or noticeable to the user U, particularly over time. Even so, it will be appreciated that with the average cap C without the weighted pouch 20 only weighing about three to four ounces (3-4 oz.), adding the weighted pouch 20 effectively doubles the weight of the cap C and makes it much less likely that the cap C is blown off a person's head H in the wind, and in the event the cap C is dropped or blown off, the weighted pouch 20 also prevents the cap C from being blown as far away, rendering retrieval that much easier. Furthermore, the pouch 20 can act as a cooler or warmer of sorts, or effectively a heat exchanger, depending on the usage and ambient conditions. By way of illustration and not limitation, if the pouch apparatus 20 were to be cooled prior to wearing, whether still on the cap C or not yet installed, as by placing the pouch 20 in a climate controlled area such as a refrigerator/freezer, ice chest, etc. or in a temperature-controlled air stream such as on or in front of an HVAC air vent, when worn, the pouch 20 would then have a nice cooling effect on the head H when ambient conditions are warm or hot. To that end, while BBs as the weighted material 70 can have such an effect or even a fabric or rubber pouch body 30, it will be appreciated that other materials of sufficient density also known for their thermal exchange properties, including controlled heat exchange functionality for longer lasting effects, may be employed in the pouch body 30 and/or as the weighted material 70, such as a refrigerant gel or other such reusable thermal mass. Likewise, to combat cool or cold ambient conditions, the pouch apparatus 20 may be heated prior to use or wearing, as through a convection or microwave oven, a heated bath, or proximity to an induction coil or a warm air HVAC duct, for example. Clearly not all materials for the pouch body 30 or the weighted material 70 are well-suited to also serving as a heat exchanger or to being heated or cooled in particular ways (e.g., microwave heating would not be appropriate for a BB-filled pouch 20), and so those skilled in the art will thus appreciate once more that a variety of materials, whether now known or later developed, and related uses are possible according to aspects of the present invention without departing from its spirit and scope. Relatedly, and by way of still further illustration and not limitation, the pouch body 30 and/or the weighted material 70 may be selected having moisture impermeability or resistance such as to contain a thermal exchange gel or liquid or having moisture permeability and absorption for wicking or sweat absorption, in either case having a heat exchange effect, and in the case of the pouch body 30 whether on one or both sides 36, 38. All such materials and effects now known or later developed as being consistent with the other aspects of the present invention may be employed, such that any exemplary materials described herein are to be understood as merely illustrative and non-limiting.

Finally, referring to FIG. 11, a further beneficial use of a cap strap weighted pouch apparatus 20 according to aspects of the present invention as removably installed on an exemplary adjustable cap C is illustrated, where a menacing assailant A has approached a user U of the apparatus 20 in a threatening way. Quickly and conveniently, the user U can remove the cap C from his head H as by grasping the bill B, and when held overhead as shown with the weighted pouch 20 dangling from the back of the cap C, it will be appreciated that the cap C instantly becomes effectively a self-defense weapon somewhat in the nature of a police sap or blackjack, such that a swinging- or whipping-type motion can result in striking a person or object with the weighted pouch 20—not at all lethal force but if properly used can inflict a sufficient blow to deter such an assailant A. And it will be appreciated by those skilled in the art that the weighted pouch 20 does not otherwise interfere with the normal wear or use of the cap C as illustrated in FIG. 10 and even somewhat covertly disguises its very presence on the cap C as effectively a hidden or secret weapon that can be taken with a user U wherever he or she goes.

In closing, regarding the exemplary embodiments of the present invention as shown and described herein, it will be appreciated that a new and novel cap strap weighted pouch apparatus is disclosed and configured for removable installation on an adjustable cap strap so as to provide a variety of functional benefits in use. Because the principles of the invention may be practiced in a number of configurations beyond those shown and described, it is to be understood that the invention is not in any way limited by the exemplary embodiments but is generally able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor for carrying out the invention. Of course, variations on these described embodiments will become apparent to those of ordinary skill in the art upon reading the foregoing description. The inventor expects skilled artisans to employ such variations as appropriate, and the inventor intends for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with any appended claims here or in any patent application claiming the benefit hereof, and it is made clear that the inventor believes that the claimed subject matter is the invention.

What is claimed is:

1. A cap strap weighted pouch apparatus for being selectively positioned on an at least one adjustment strap of a cap configured to be worn, the apparatus comprising:

a pouch body formed having a front side, an opposite back side, a first lengthwise side edge, and a second lengthwise side edge, wherein each of the front and back sides is a flexible material, the pouch body further having spaced apart first and second pouch slits inset from the first and second lengthwise side edges, the first and second pouch slits formed as transverse openings within the flexible material of each of the front and back sides communicating between and completely through the front and back sides for selective removable receipt therethrough of the at least one adjustment strap in selectively positioning the pouch body on the at least one adjustment strap and thus the apparatus on the cap, wherein the pouch body is formed having a pouch interior space between the front and back sides, the pouch interior space being spaced apart and isolated from the first and second pouch slits; and a weighted material selected from a group consisting of metal balls, sand, beads, beans, gel, and liquid non-removably and entirely contained within the pouch interior space, whereby when the apparatus is configured to be selectively positioned on the cap as by passing the at least one adjustment strap through the first and second pouch slits and then securing the at least one adjustment strap lying outwardly along one of the front and back sides of the pouch body, the cap can be selectively worn with the apparatus so installed, the apparatus thereby discouraging unwanted removal of the cap while allowing selective removal of the cap for use in self-defense based on the weighted material of the apparatus.

2. The apparatus of claim 1 wherein the weighted material comprises the metal balls, the metal balls comprising approximately three hundred nominally 0.177-inch diameter steel metal balls weighing approximately three ounces.

3. The apparatus of claim 1 wherein a moisture impermeable material interior layer is provided on the front and back sides of the pouch body for retention of the weighted material within the pouch interior space.

4. The apparatus of claim 1 wherein the pouch body is of a tubular construction with the opposite front and back sides joined along the first and second lengthwise side edges, respectively, and further wherein the front and back sides are joined oppositely widthwise inset from the first and second pouch slits so as to bound the pouch interior space isolated from the first and second pouch slits.

5. The apparatus of claim 4 wherein the front and back sides are joined oppositely widthwise inset from the first and second pouch slits via opposite first and second widthwise intermediate stitches, the pouch interior space being bound by the first and second lengthwise side edges and the opposite first and second widthwise intermediate stitches.

6. The apparatus of claim 5 wherein the first and second pouch slits are bound thereabout across the front and back sides via respective first and second pouch slit stitches.

7. The apparatus of claim 1 wherein the front and back sides are joined along the first lengthwise side edge via a first lengthwise edge stitch and along the second lengthwise side edge via an opposite second lengthwise edge stitch, and further wherein the front and back sides are joined along a first widthwise edge via a first widthwise edge stitch and along an opposite second widthwise edge via an opposite second widthwise edge stitch.

8. The apparatus of claim 7 wherein opposite first and second widthwise intermediate stitches intersect the opposite first and second lengthwise edge stitches to bound the pouch interior space isolated from the first and second pouch slits, and further wherein the first pouch slit is formed lengthwise between the first widthwise edge stitch and the adjacent first widthwise intermediate stitch and the second pouch slit is formed lengthwise between the second widthwise edge stitch and the adjacent second widthwise intermediate stitch.

9. The apparatus of claim 8 wherein the first and second pouch slits are formed widthwise between the opposite first and second lengthwise edge stitches, whereby the first and second pouch slits are fully formed and bound within the front and back sides of the pouch body isolated from the pouch interior space.

10. The apparatus of claim 1 wherein the flexible material of the front and back sides is a same material.

11. The apparatus of claim 1 wherein the flexible material of the front side is different material than the flexible material of the back side.

12. The apparatus of claim 1 wherein the flexible material of one or both of the front and back sides is selected from a group consisting of a textile and rubber.

13. The apparatus of claim 12 wherein the flexible material of one or both of the front and back sides comprises the textile, the textile comprising seventeen to twenty-one ounce heavyweight denim.

14. The apparatus of claim 1 wherein the material of one or both of the front and back sides incorporates one or more of moisture impermeability, moisture permeability, an anti-fungal agent, and an anti-bacterial agent.

15. The apparatus of claim 1 wherein one or both of the pouch body and the weighted material is configured having thermal exchange properties.

16. A method of employing the cap strap weighted pouch apparatus as defined in claim 1, the method comprising the steps of:

disengaging the at least one adjustment strap of the cap;

passing the at least one adjustment strap through the respective first and second pouch slits so that the at least one adjustment strap lies outwardly along one of the front and back sides of the pouch body; and reengaging the at least one adjustment strap so as to secure the at least one adjustment strap on the cap and the apparatus on the at least one adjustment strap and thus the cap.

17. A cap strap weighted pouch apparatus for being selectively positioned on an at least one adjustment strap of a cap configured to be worn, the apparatus comprising:

a pouch body formed having a first side and an opposite second side and further having spaced apart first and second pouch slits formed in and communicating between the first and second sides for selective removable receipt therethrough of the at least one adjustment strap in selectively positioning the pouch body on the at least one adjustment strap and thus the apparatus on the cap; and a weighted material incorporated into the pouch body, whereby when the apparatus is configured to be selectively positioned on the cap as by passing the at least one adjustment strap through the first and second pouch slits and then securing the at least one adjustment strap, the cap can be selectively worn with the apparatus so installed, the apparatus thereby discouraging unwanted removal of the cap while allowing selective removal of the cap for use in self-defense based on the weighted material of the apparatus;

wherein the pouch body is formed having a pouch interior space between the first and second sides, the pouch interior space being isolated from the first and second pouch slits, and further wherein the weighted material is contained within the pouch interior space; and wherein the pouch body is of a tubular construction with the opposite first and second sides joined along respective opposite first and second lengthwise edges, and further wherein the first and second sides are joined oppositely widthwise inset from the first and second pouch slits so as to bound the pouch interior space isolated from the first and second pouch slits.

* * * * *